US005586697A

United States Patent [19]

Johansson

[11] Patent Number: 5,586,697

[45] Date of Patent: Dec. 24, 1996

[54] GARMENT HANGER

[76] Inventor: Gert A. Johansson, Hammarsbacke 36, S-443 38 Lerum, Sweden

[21] Appl. No.: 488,745

[22] Filed: Jun. 8, 1995

[51] Int. Cl.[6] ..... A47G 25/14; G09F 19/00

[52] U.S. Cl. ..... 223/85; 40/322

[58] Field of Search ..... 40/322, 484, 493; 116/200, 306, 307, 309, 311; 223/85

[56] References Cited

U.S. PATENT DOCUMENTS

| | | | |
|---|---|---|---|
| 1,369,170 | 2/1921 | Gilbert et al. | 40/493 |
| 1,575,775 | 3/1926 | Lesser | 40/322 |
| 3,518,963 | 7/1970 | Tucker | 40/493 |
| 3,898,754 | 8/1975 | Johansson . | |
| 4,006,547 | 2/1977 | Samuels | 40/322 |
| 4,017,990 | 4/1977 | Garrison | 40/322 |
| 4,115,940 | 9/1978 | Phillips . | |
| 4,224,894 | 9/1980 | Haldemann | 40/495 |
| 4,679,340 | 7/1987 | Johansson . | |
| 4,863,078 | 9/1989 | Bergsch | 40/322 |
| 4,909,178 | 3/1990 | LeBrocq | 116/309 |
| 5,096,101 | 3/1992 | Norman et al. . | |
| 5,135,141 | 8/1992 | Harmer et al. | 40/322 |
| 5,199,608 | 4/1993 | Zuckerman . | |

*Primary Examiner*—Bibhu Mohanty
*Attorney, Agent, or Firm*—Samuels, Gauthier, Stevens & Reppert

[57] ABSTRACT

A one-piece garment hanger including a hanger body and a hook member formed integrally with the hanger body. The hanger further includes an elongate member integrally formed with the hanger such that the elongate member partially delimits an opening in the hanger. The opening is sufficiently large to permit a cylindrical information marker to rotate about the elongate member when the marker is attached to the elongate member.

16 Claims, 2 Drawing Sheets

GARMENT HANGER

TECHNICAL FIELD

The present invention relates to a garment hanger to which a clothing information marker may be attached.

BACKGROUND OF THE INVENTION

Traditionally, garment hangers have been made from two pieces, i.e. a metal hook member of generally circular cross-section and a normally wooden or plastic hanger body. In order to assist a potential purchaser in assessing the suitability of goods on offer in a store, an information marker is often attached to the garment hanger. Such information markers may typically display information relating to the size or type of garment hung on the hanger.

For traditional garment hangers, it is known to use information markers which are provided with a through hole to allow the markers to be slipped over the free end of the hook member of the garment hanger. While such an arrangement ensures that the information marker cannot be inadvertently dislodged from the garment hanger, one disadvantage associated with such markers is that the garment hanger has to be lifted from a hanging rail when it is desired to add or remove a marker.

Accordingly, information markers have been developed which can be clipped to a traditional garment hanger without the need to lift the garment hanger from its hanging rail. Typical of such information markers are those disclosed in U.S. Pat. Nos. 3,898,754 and 4,679,340. The type of marker disclosed in U.S. Pat. No. 4,679,340 is particularly advantageous due to its symmetry about a horizontal plane, thereby avoiding the need to orient the marker in the apparatus which prints indicia onto the information marker.

In recent years, in order to rationalize the production process, there has been a move towards plastic one-piece hangers, i.e. the hanger body and hook member are integrally molded in a plastics material. To impart sufficient strength to the hook member, its cross-section can no longer be circular, but is instead substantially I-shaped. This implies that it is no longer possible to use the type of marker as disclosed in the above-mentioned U.S. Pat. Nos. 3,898,754 or 4,679,340 with such one-piece hangers.

A number of one-piece plastic hangers is known, which hangers are provided with a member or portion to which an indicia carrying tab can be mounted. Various such hanger and tab arrangements are described in, for example, U.S. Pat. Nos. 4,115,940, 5,096,101 and 5,199,608. Common to all these arrangements is that the indicia carrying tabs are relatively small and any text thereon must be printed vertically. Thus, legibility of the information carried on the tabs is poor. Furthermore, consumers are used to seeing the previous types of product information markers and there is a natural reluctance to accept change. In addition, many retailers have existing stocks of cylindrical information markers of the type according to the above-mentioned U.S. Pat. No. 4,679,340 which are unusable on existing one-piece hangers.

SUMMARY OF THE INVENTION

It is therefore an object of the present invention to provide a one-piece hanger on which a conventional cylindrical information marker can be mounted.

This object is achieved in accordance with the present invention by means of a one-piece garment hanger comprising a hanger body and a hook member formed integrally with said hanger body, said hanger further comprising an elongate member integrally formed with said hanger, said elongate member partially delimiting an opening in said hanger, wherein said opening is sufficiently large to permit a substantially cylindrical information marker to rotate about said elongate member when said marker is attached to said elongate member.

In this manner, it is now possible to utilize previously known cylindrical information markers on one-piece garment hangers.

BRIEF DESCRIPTION OF THE DRAWINGS

The invention will be described in the following by way of example only and with reference to the attached drawings, in which.

DETAILED DESCRIPTION OF PREFERRED EMBODIMENTS

Figure 1:
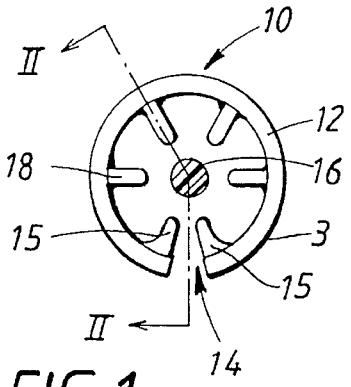
FIG. 1 PRIOR ART
FIG. 1 is a plan view of a prior art cylindrical clothing information marker for use with the garment hanger according to the present invention.
Figure 2:
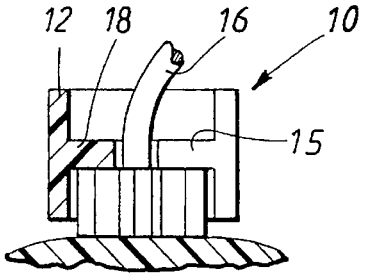
FIG. 2 PRIOR ART
FIG. 2 is a sectional view along line II—II of FIG. 1.

In FIGS. 1 and 2, reference numeral 10 generally denotes a clothing information marker which may be used with the garment hanger according to the present invention. The clothing information marker 10 is described in U.S. Pat. No. 4,679,340, the contents of which are hereby incorporated by reference. The marker comprises a cylindrical wall 12 which is provided with a vertical slot 14 traversing the full vertical height of the wall 12. A pair of inwardly directed, converging protrusions 15 are integrally formed or otherwise affixed to the inner periphery of the cylindrical wall 12. Thus, the slot 14 presents an entrance which is wider than the diameter or width of a hook member 16 associated with a garment hanger to thereby allow the marker 10 to be pushed onto the hook member 16. Due to the converging nature of the protrusions 15, the marker cannot be removed from the hook member 16 unless the marker is resiliently deformed. The marker is centered on the hook member 16 by the provision of radially inwardly extending lugs 18. In this manner, the marker 10 is free to rotate about the hook member 16.

The dimensions of the information marker 10 can vary depending, for example on the amount of information which it is intended to display. Typically though, the marker has a diameter of between 10 and 15 mm, a length of 7 to 12 mm and can be affixed to a hook member having a diameter of between 1 and 4 mm.

Figure 3:
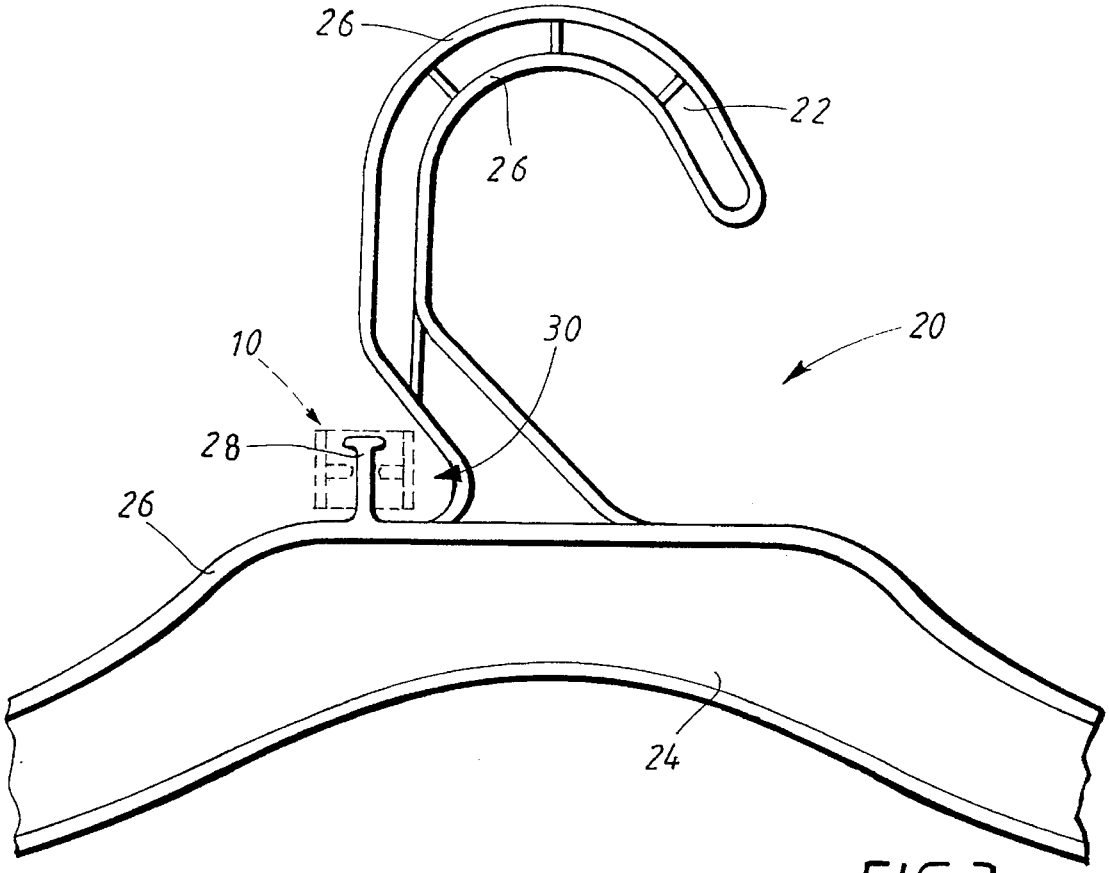
FIG. 3 is an elevational view of a first embodiment of the garment hanger according to the present invention.
Figure 4:
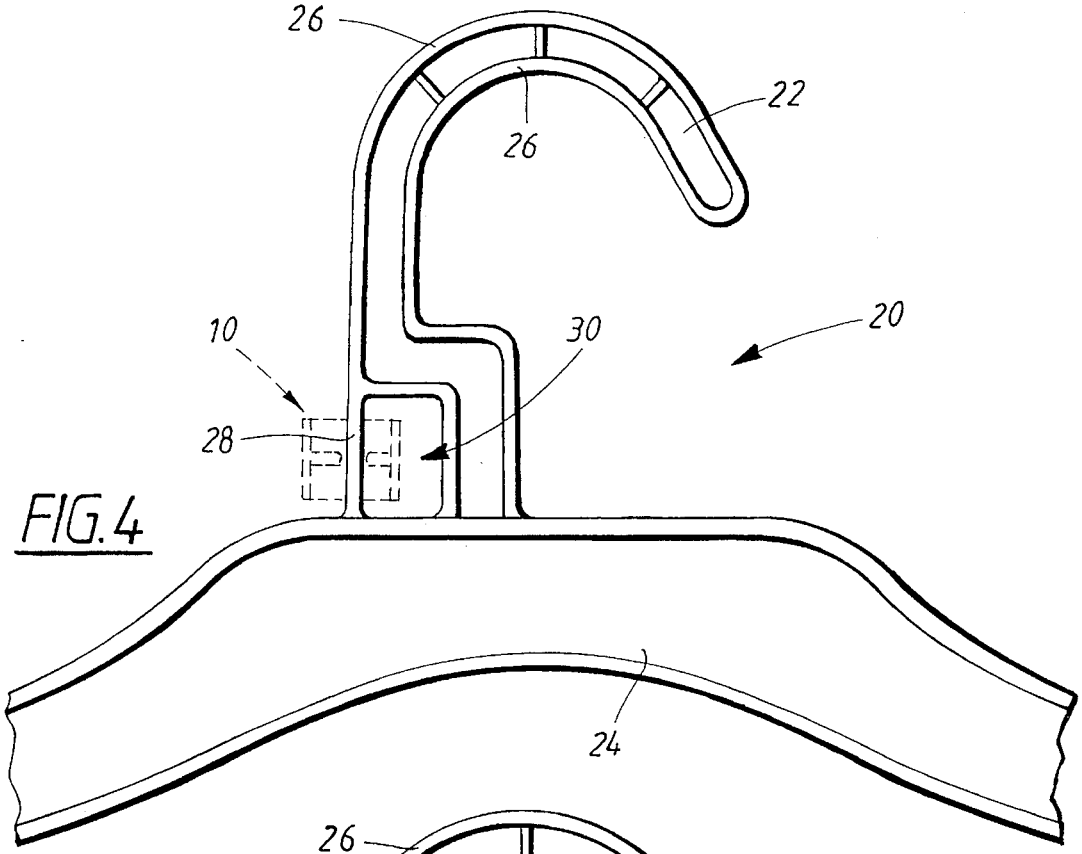
FIG. 4 is an elevational view of a second embodiment of the garment hanger according to the present invention.
Figure 5:
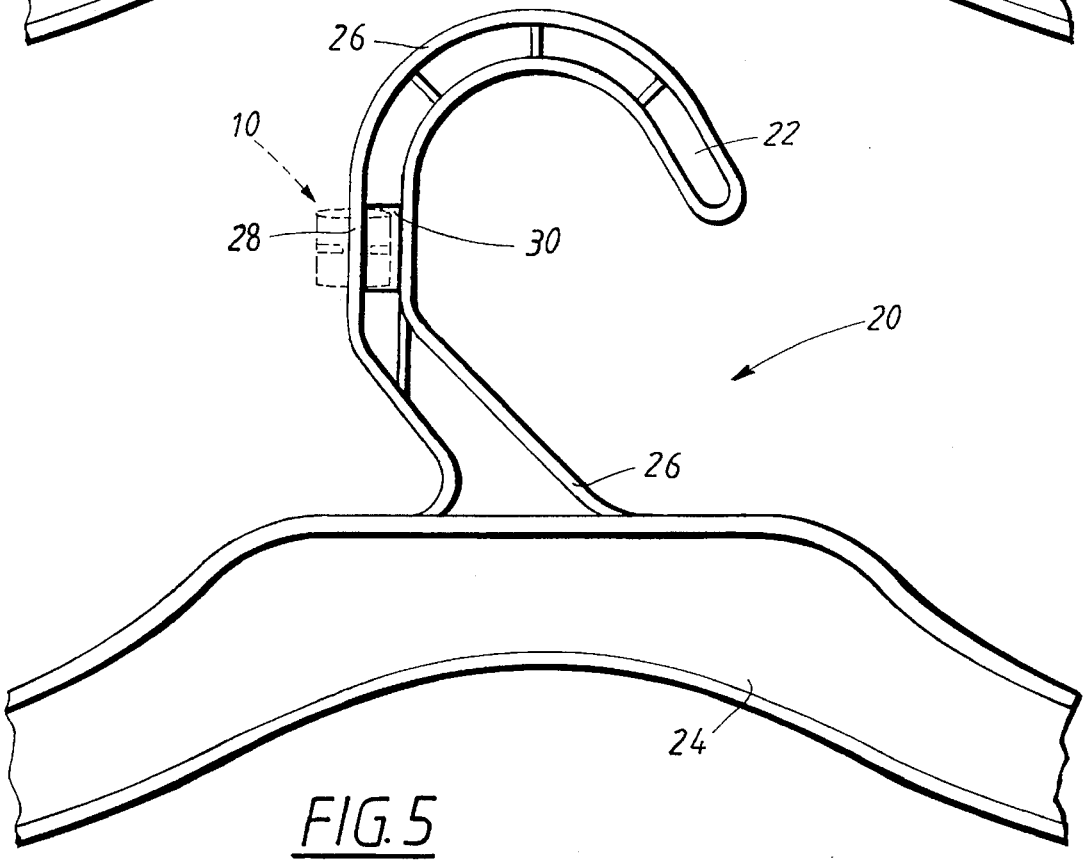
FIG. 5 is an elevational view of a third embodiment of the garment hanger according to the present invention.

In FIGS. 3 to 5, reference numeral 20 generally denotes a garment hanger according to the present invention. The hanger 20 is preferably molded from a thermoplastic material and includes a hook member 22 formed integrally with a hanger body 24. The hanger is generally planar and has a transverse reinforcing wall or rib 26 extending around its periphery to thereby form an I-beam type construction. As shown in FIGS. 3 and 5, the hook member 22 may extend at an angle to the hanger body 24, whereas in FIG. 4 the hook member 22 may extend substantially perpendicularly to the hanger body 24.

In accordance with the present invention, the garment hanger 20 is provided with an elongate member 28 integrally formed with the hanger. The elongate member 28 is arranged to partially delimit an opening 30 in the hanger, with the opening 30 being sufficiently large to permit the cylindrical information marker 10 to rotate about the elongate member 28 when the marker 10 is attached to the elongate member.

Thus, in FIG. 3, the elongate member 28 is in the form of a pin or peg extending substantially perpendicularly from the hanger body 24 in a plane occupied by the hook member 22. The elongate member 28 extends towards the hook member 22 such that an opening 30 is formed which is delimited in part by the elongate member 28, the hook member 22 and the hanger body 24. The elongate member, the hook member and the hanger body are arranged with respect to each other such that when the cylindrical clothing information marker 10 is attached to the elongate member 28, as indicated by the dashed lines in FIG. 3, the marker is free to rotate about the elongate member.

In FIG. 4, the elongate member 28 is arranged to extend between the hanger body 24 and the hook member 22 such that an opening 30 is created which is delimited by the elongate member 28 and portions of the hook member 22 and the hanger body 24. One advantage with this embodiment over that illustrated in FIG. 3 is that the elongate member 28 also serves to support the hook member 22.

In a preferred embodiment of the invention depicted in FIG. 5, the elongate member 28 is integral with the hook member 22 such that an opening 30 is created which is in the form of a slot accommodated within the hook member 22. Preferably, the slot 30 is provided in a portion of the hook member which extends substantially vertically when the garment hanger hangs from a hanging rail.

So that the clothing marker 10 may be easily attached to the elongate member 28, it is advantageous if the elongate member has a substantially circular cross section of about 2 mm diameter.

It is to be understood that the invention is not restricted to the embodiments described above and shown in the drawings, but may be varied within the scope of the appended claims. For example, it is conceivable that the elongate member illustrated in FIG. 3 extends from a portion of the hook member rather than from the body member.

What is claimed is:

1. In combination a one-piece garment hanger and a substantially cylindrical information marker, said hanger comprising a hanger body and a hook member formed integrally with said hanger body, said hanger further comprising an elongate member integrally formed with said hanger, said elongate member partially delimiting an opening which is defined between a portion of said hook member and said elongate member, wherein said opening is sufficiently large to permit said substantially cylindrical information marker to rotate about said elongate member when said marker is attached to said elongate member, said substantially cylindrical information marker comprising a cylindrical ring wall and a slot through said ring wall which said elongate member passes to attach said marker to said elongate member.

2. The garment hanger as claimed in claim 1, wherein said elongate member extends substantially perpendicularly from said hanger body in a plane occupied by said hook member.

3. The garment hanger as claimed in claim 2, wherein said elongate member extends towards said hook member such that said opening is delimited in part by said elongate member, said hook member and said hanger body.

4. The garment hanger as claimed in claim 1, wherein said elongate member extends between said hanger body and said hook member such that said opening is delimited by said elongate member and portions of said hook member and said hanger body.

5. The garment hanger as claimed in claim 1, wherein said elongate member is integral with said hook member such that said opening is in the form of a slot accommodated within said hook member.

6. The garment hanger as claimed in any one of claims 1 to 5, wherein said elongate member has a substantially circular cross section of about 2 mm diameter.

7. The combination of claim 1, wherein said elongate member is formed integrally with said hanger body and adjacent said hook member.

8. The combination of claim 1, wherein said elongate member is formed integrally with said hook member so that said opening is defined within said hook member.

9. A one-piece garment hanger assembly comprising:

a hanger body;

a hook member formed integrally with said hanger body;

an elongate member partially delimiting an opening which is defined between a portion of said hook member and said elongate member; and a substantially cylindrical information marker attached to and rotatable about said elongate member within said opening, said marker comprising a cylindrical ring wall and a slot through said ring wall which said elongate member passes to attach said marker to said elongate member.

10. The garment hanger as claimed in claim 9, wherein said elongate member extends substantially perpendicularly from said hanger body in a plane occupied by said hook member.

11. The garment hanger as claimed in claim 10, wherein said elongate member extends towards said hook member such that said opening is delimited in part by said elongate member, said hook member and said hanger body.

12. The garment hanger as claimed in claim 9, wherein said elongate member extends between said hanger body and said hook member such that said opening is delimited by said elongate member and portions of said hook member and said hanger body.

13. The garment hanger as claimed in claim 9, wherein said elongate member is integral with said hook member such that said opening is in the form of a slot accommodated within said hook member.

14. The garment hanger as claimed in claim 9, wherein said elongate member has a substantially circular cross section of about 2 mm diameter.

15. The hanger assembly of claim 7, wherein said elongate member is formed integrally with said hanger body and adjacent said hook member.

16. The hanger assembly of claim 7, wherein said elongate member is formed integrally with said hook member so that said opening is defined within said hook member.

* * * * *